US011704976B1

(12) United States Patent
Putnam

(10) Patent No.: US 11,704,976 B1
(45) Date of Patent: Jul. 18, 2023

(54) WAGERING SYSTEM AND METHOD EMPLOYING PSEUDORANDOM ASSIGNMENT

(71) Applicant: Miles Putnam, Ann Arbor, MI (US)

(72) Inventor: Miles Putnam, Ann Arbor, MI (US)

( * ) Notice: Subject to any disclaimer, the term of this patent is extended or adjusted under 35 U.S.C. 154(b) by 65 days.

(21) Appl. No.: 17/574,217

(22) Filed: Jan. 12, 2022

(51) Int. Cl.
*G07F 17/32* (2006.01)

(52) U.S. Cl.
CPC ..... *G07F 17/3288* (2013.01); *G07F 17/3206* (2013.01); *G07F 17/3223* (2013.01)

(58) Field of Classification Search
None
See application file for complete search history.

(56) References Cited

U.S. PATENT DOCUMENTS 11,127,254 B2 * 9/2021 Oberberger ..... G07F 17/3206
2019/0147702 A1 * 5/2019 Malek ..... G07F 17/3255 463/25
2020/0372761 A1 * 11/2020 Oberberger ..... G07F 17/34

* cited by examiner

*Primary Examiner* — Ronald Laneau
(74) *Attorney, Agent, or Firm* — Heed Law Group; Thomas P. Heed

(57) ABSTRACT

A system and method for pseudorandomly assigning a side to a gambler in event betting, such as sports betting. The system and method allow for a gambler to bet on past, present, future, electronic, or simulated events. When the gambler indicates the intention to accept a random assignment of a side, a wagering server pseudorandomly selects a side for the gambler. The system and method can be extended to contingent bets and batched betting.

20 Claims, 8 Drawing Sheets

WAGERING SYSTEM AND METHOD EMPLOYING PSEUDORANDOM ASSIGNMENT

FIELD OF INVENTION

This invention relates to the classifications for sports; games; amusement, and to one or more sub-classification related to games using electronic circuits not otherwise provided for. More specifically, the present invention is a pseudorandomized wagering system and method.

BACKGROUND OF INVENTION

In the realm of gambling, there are games of skill and games of chance. The expected outcome is the probability of the gambler winning or losing a particular bet. The odds are related to the expected outcome. The odds are the payment a gambler should expect to receive from a bet of a predefined size. Statistically, in a game of skill, the expected outcome can be affected by the skill of the gambler. This means that certain games of skill can have advantageous odds for the skilled gambler. In a game of chance, the expected outcome is unaffected by the skill of the gambler.

For example, Lottery tickets and slot machines are games of chance, wherein the skill level of the gambler is utterly meaningless with respect to the expected outcome.

Blackjack and poker are games of skill, in which the individual player's own gambling acumen can greatly affect their expected outcome on each hand. Over the course of many hands, the skilled gambler would experience a much more favorable expected outcome than in inexperienced gambler, when playing a game of skill.

Sports betting or event betting ("event betting") is a game of skill, like blackjack or poker, because the gambler's knowledge and insight into the underlying sporting event affects the gamblers expected outcome. In event betting, a gambler can either pick a side with odds, a side with a point spread, or the outcome of a proposition. A proposition bet in event betting is made concerning the occurrence or non-occurrence of a particular proposition during the event. Examples of proposition bets ("prop bets") include, but are not limited to, the number of strikeouts a pitcher records in a baseball game, the first player to score in a basketball game, whether a non-offensive player scores in a football game, which side will score first in a football game, and which side will record more fouls in a basketball game. Prop bets are limited only by the imagination of the gambler and the willingness of someone to accept the bet.

The problem with event-based betting regimes is that they require the gambler to have good knowledge-base about the particulars of the event. The gambler does not always possess such knowledge. For example, a gambler may follow his hometown team closely, but have only passing knowledge about the remainder of the teams in the league. If such a gambler wished to place a bet on a game in which the gambler possessed insufficient knowledge to make an educated bet, the gambler is left with the option of either guessing or foregoing the chance to place a bet.

Invariably, because of how event betting odds work, an ignorant gambler can be left in a position that is significantly worse than making a blind bet on a game of chance. In other words, event-based betting has disadvantageous odds for gamblers who lack a sufficient knowledge base. This often results in gamblers either making an ill-advised bet or foregoing betting on a particular event, altogether. In one instance, the gambler is disadvantaged; in the other, the sports book is disadvantaged.

What the gambling market needs is a pseudorandomized way to assign event-based bets, so that the odds for an ignorant gambler can be improved. In other words, what the gambling market needs is a pseudorandomized assignment of event-based bets, so that the event-based bet becomes a game of chance from the perspective of the gambler.

SUMMARY OF THE INVENTION

This summary is intended to disclose a pseudorandomized wagering system and method for event betting. This summary is not intended to limit the scope of the claimed subject matter. Rather, it is intended to provide one skilled in the art with an overview of the invention by referencing its main embodiments. The invention taught extends beyond the simplified concepts taught in this summary.

To explain the present invention, it is necessary to first review the current state of the art in event betting. Event betting is usually only allowed in certain jurisdictions. The jurisdiction has a clearly defined boundary. A gambler at a location within the boundary of the jurisdiction is allowed to place an event bet. A gambler at a location outside of the boundary of the jurisdiction would not be allowed to place an event bet. When a gambler is physically present at a sports book, they are clearly within the allowed jurisdiction.

Take as an example, a gambler who wishes to place a traditional event bet on a sporting event that is presently happening or will happen in the future. When the gambler is using an electronic device to place the bet, the system must first vet their location. The electronic device is comprised of a global positioning system ("GPS") chipset, graphics driver, memory, communications chip, and screen. The electronic device sends a wager communication, or query, over a communication network to a wagering server, requesting to make an event bet on a sporting event. The server first sends a location query to determine the location of the electronic device, using the location of the electronic device, as provided by the GPS chipset, as a proxy for the location of the gambler. Once the location has been determined, and the gambler is allowed to place an event bet on the sporting event, the server checks an historical database in order to determine the appropriate odds. The odds are communicated back to the gambler's electronic device over the communications network. The gambler uses the electronic device to place a bet, if the gambler accepts the odds. The gambler then watches the sporting event. At the conclusion of the sporting event, the event is graded. If the gambler's preferred side or team prevailed, the server issues payment.

Much of the prior art architecture is incorporated in the present invention, although its system and method is necessarily varied from the prior art in order to meet the needs of a pseudorandomized event bet. Betting on events in a manner that makes them a game of chance is usually only allowed in certain jurisdictions. It must be noted that in the present invention, the jurisdiction must allow games of chance. The jurisdiction has a defined boundary. A gambler at a location within the boundary of the jurisdiction is allowed to place a game-of-chance bet related to a sporting event. A gambler at a location outside of the boundary of the jurisdiction would not be allowed to place such a bet. The jurisdiction and its boundary may also allow traditional sports betting.

Before proceeding, it is necessary to discuss the difference between random and pseudorandom. Statistically, a random process produces unpredictable results, even if all initial conditions are known. A pseudorandom process is often used in software to mimic a random process. A pseudorandom process uses an algorithm to arrive at an outcome that, when combined with those happening before and after, appear to be statistically random. However, a pseudorandom process will yield the identical results if it is replicated with the same initial conditions.

Most online casinos have settled on pseudorandom number generators to create pseudorandom events, because a pseudorandom number generator is cost-efficient and exhibits periodicity. This allows a gambling process performed with a pseudorandom number generator to be inspected and audited by a casino control board or other jurisdictional oversight body.

A linear congruential generator ("LCG") is the most common algorithm for generating a pseudo-random outcome. The LCG requires a seed number to begin. The seed number is represented by $X_0$. The pseudorandom outcome, $X_{n+1}$, in the sequence of pseudo-random values is calculated as:

$$X_{n+1}=(aX_n+c)\bmod m$$

where m is the modulus, a is the multiplier such that 0<a<m, and c is the increment such that 0<=c<m. The seed value for the generator must be $0<=X_0<m$.

Most software programming languages have a simple function for producing pseudorandom numbers, such as the LCG techniques explained above. This invention does not place a claim to any particular type of algorithm for generating a pseudorandom. Rather, this invention is concerned with applying a seemingly pseudorandom outcome to assigning a side in an event-based bet. To the gambler, the assignment would appear to be random. To the sports book, the assignment is pseudorandom. For the sake of clarity in this application, the gambler will be accepting a random side assignment and placing a random bet; the sports book or algorithm will be using a pseudorandom process to assign a side.

The gambler would interact with a wagering server by either (1) being present at the sports book; or (2) using an electronic device to communicate with the wagering server using a near-field communication protocol such as wi-fi, a satellite system, a cellular system, the internet, or a combination of the three. Like the prior art, the electronic device used in the system of the present invention would be comprised of a GPS chipset, graphics driver, memory, communications chip, and screen. The first thing the system and method would do is vet the gambler's current location, to verify that the gambler is in a jurisdiction which allows a game of chance by querying the GPS chipset of the electronic device. If the gambler is present at a sports book, this step in the method is trivial.

In a first embodiment of the invention, the gambler desires to wager on a past, present, future, electronic, or simulated event, such as a football game. Assuming that the gambler is using an electronic device, the electronic device queries the wagering server. However, rather than picking a team for the bet, the gambler is pseudorandomly assigned a team by selecting the random betting option.

In a second embodiment, available only for present or future events the gambler is presented with a split screen showing the gambler the odds for both a normal bet in which the gambler would pick a side, such as a particular team; and a random bet in which the gambler would be pseudorandomly assigned a side. The electronic device communicates information to the wagering server. In this embodiment, the gambler is presented with a choice of picking a side or having a side randomly assigned.

It is important to understand how event betting works. Imagine Team A and Team B playing a football game. For the sake of this example, this application will consider a bet against a point spread. However, the present invention is equally applicable to a bet made without reference to a point spread.

This example will start with the prior art bet. The gambler would communicate with the wagering server in order to view the odds. The betting server would base the odds on the results from an historical database. Let the odds be Team A −3 (−110) and Team B +3 (−110). This nomenclature means that the gambler would have to place a bet of $110 dollars in order to win $100. The gambler can choose Team A, giving three points (meaning that Team A needs to win by more than 3 points in order for the gambler to win). Alternatively, the gambler can choose Team B, getting three points (meaning that Team B needs to win or lose by fewer than 3 points in order for the gambler to win the bet). If Team A wins by exactly 3 points, the bet is a push, meaning that the wager would be returned to the gambler.

In order to place the prior art bet, the gambler would pick either Team A or Team B based off of the odds given by the wagering server, and would communicate the bet to the server. For this example, the gambler selects Team A giving 3 points and places a $110 bet. If Team A wins by more than 3 points, the gambler receives $100 plus their original bet of $110. If Team A wins by exactly three points, the bet is a push, and the gambler receives their original wager of $110 back. If Team A wins by less than three points, or if Team A loses, the event would be graded as a loss to the gambler and the gambler's wager would be retained by the sports book.

For the first embodiment of the present invention bet, the gambler would communicate with the wagering server using the electronic device. For the sake of this example, the betting server would communicate the odds for randomized assignment of the gambler as Team A −3 (−105) and Team B +3 (−105). The event can be past, present, future, electronic, or simulated for such a bet. For example, the event can be an upcoming football game. The event can also be a past football game. The event can even be a simulated football game or an electronic football game wherein two people play a video game football game and the gambler bets on the winner. The gambler could not select a side or particular team; rather, the wagering server would pseudorandomly assign the gambler either Team A or Team B after the gambler communicated the intention to place a randomized wager on the event. For this example, the gambler places a $105 bet, and the wagering server assigns the gambler Team A. If Team A wins by more than 3 points, the gambler receives $100 plus their original bet of $110. If Team A wins by exactly three points, the bet is a push, and the gambler receives their original wager of $110 back. If Team A wins by less than three points, or if Team A loses, the event would be grade as a loss to the gambler and the gambler's wager would be retained by the sports book.

For the second embodiment of the present invention, the gambler is interested in wagering on a present or future event. The present invention presents a split screen on the electronic device of the gambler, showing both the normal odds and the odds for a randomly assigned wager. The split screen is available only for present or future events.

For the sake of this example of this embodiment, the wagering server would communicate the normal odds for a future event such as an upcoming football game:

Team A −3 (−110) and Team B +3 (−110).

The wagering server would also communicate the odds for a randomized assignment using the split screen:

Team A −3 (−105) and Team B +3 (−105).

The gambler could select a side, meaning a particular team, and place a bet of $110 in order to get a return of $100; or the gambler could select a randomized side assignment bet allowing the wagering server to pseudorandomly assign the gambler a side, meaning either Team A or Team B, after the gambler communicated the intention to place a bet with a randomized side assignment. For this example, the gambler decides to accept a random side assignment and place a $105 bet. The wagering server assigns the gambler Team A. If Team A wins by more than 3 points, the gambler receives $100 plus their original bet of $105. If Team A wins by exactly three points, the bet is a push, and the gambler receives their original wager of $105 back. If Team A wins by less than three points, or if Team A loses, the event would be grade as a loss to the gambler and the gambler's wager would be retained by the sports book.

This Summary is provided to introduce a selection of concepts in a simplified form that are further described below in the Detailed Description, with reference to the drawings contained in this application.

BRIEF DESCRIPTION OF THE DRAWINGS

The present invention is illustrated with 8 figures on 9 sheets. The accompanying drawings, which are incorporated in and constitute a part of this disclosure, illustrate various embodiments of both the prior art and the current invention. In the drawings.

DETAILED DESCRIPTION OF THE DRAWINGS

Figure 1:
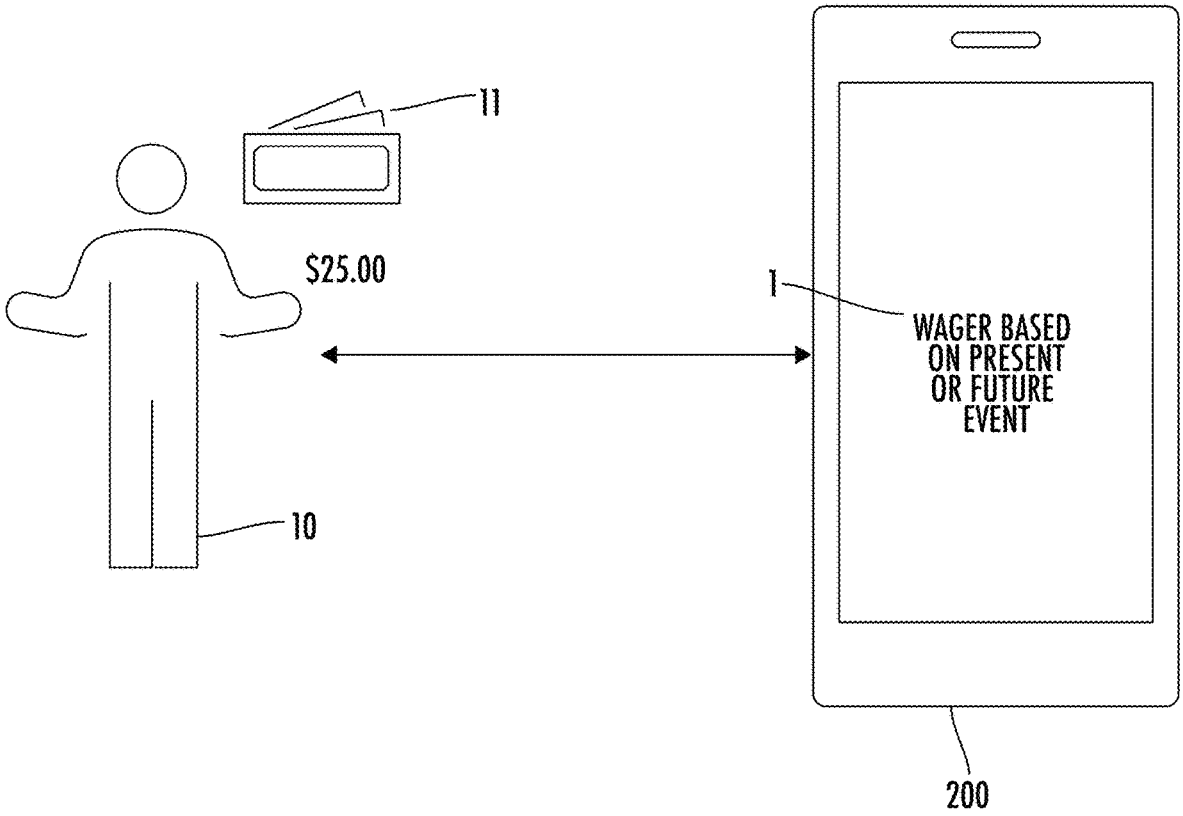
(PRIOR ART) FIG. 1
FIG. 1 is a prior art illustration, showing a gambler placing a wager on a present or future event through an electronic device.

The following descriptions are not meant to limit the invention, but rather to add to the summary of invention, and illustrate the present invention, a pseudorandomized wagering system and method for event betting. The present invention is illustrated with a variety of drawings showing the pseudorandomized wagering system and method for event betting and comparing it to the prior art system for event betting.

Certain terminology is used in the following description for convenience only and is not limiting. To assist in the description of the present invention, words such as short, long, top, bottom, side, upper, lower, front, rear, inner, outer, right and left are used to describe the relative size and orientation of the present invention in the accompanying figures. The terminology includes the words above specifically mentioned, derivatives thereof, and words of similar import.

The following detailed description refers to the accompanying drawings. Wherever possible, the same reference numbers are used in the drawings and the following description to refer to the same or similar elements. However, when an element is varied, or its concept is varied, a unique number or identifier is used. While embodiments of the claimed subject matter may be described, modifications, adaptations, and other implementations are possible. Substitutions, additions, or modifications, which perform identical functions to the embodiments disclosed, may be made to the elements illustrated in the drawings.

Figure 2:
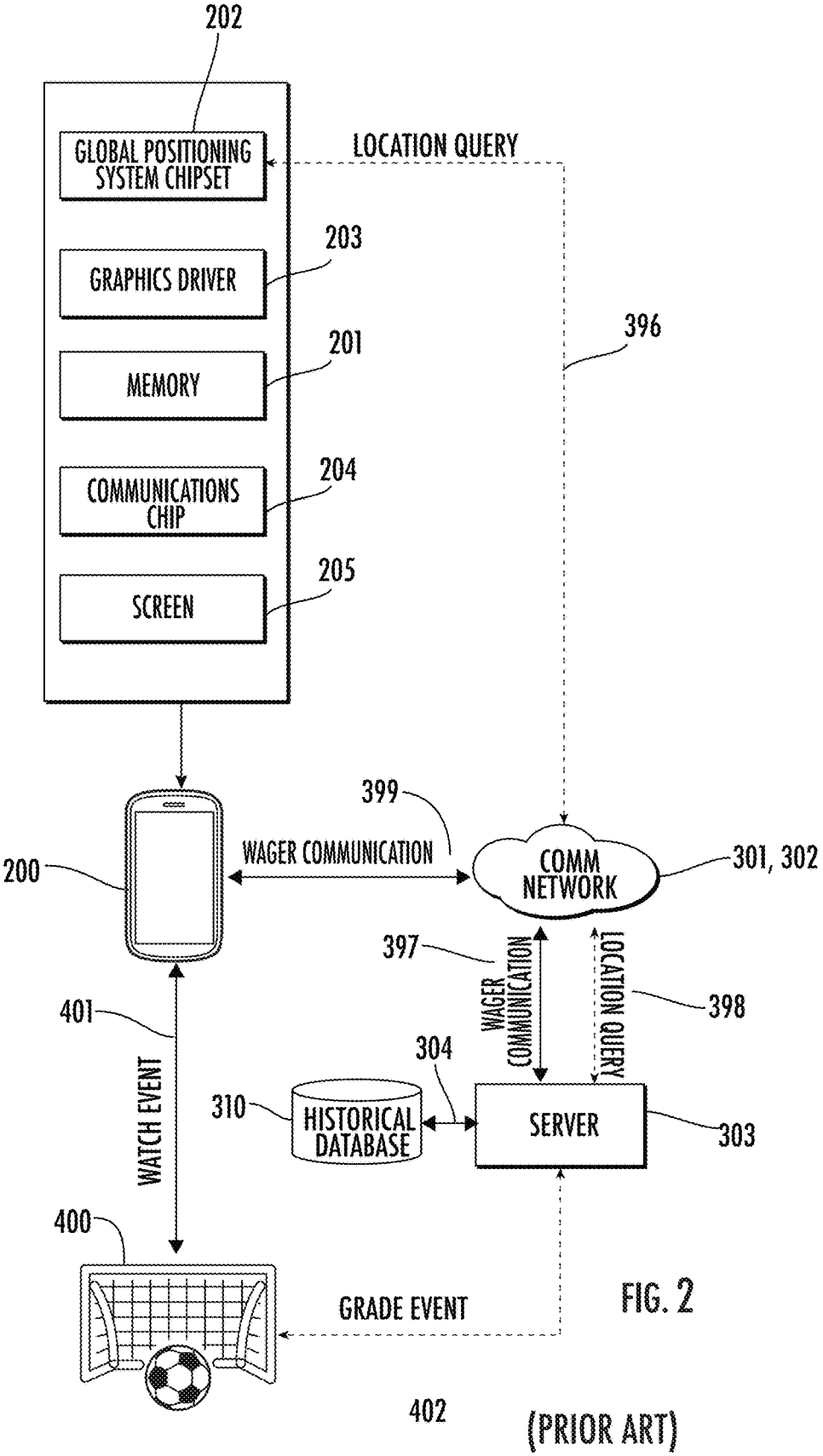
FIG. 2 (PRIOR ART)
FIG. 2 is a prior art flow chart showing event betting from a system level.
Figure 3:
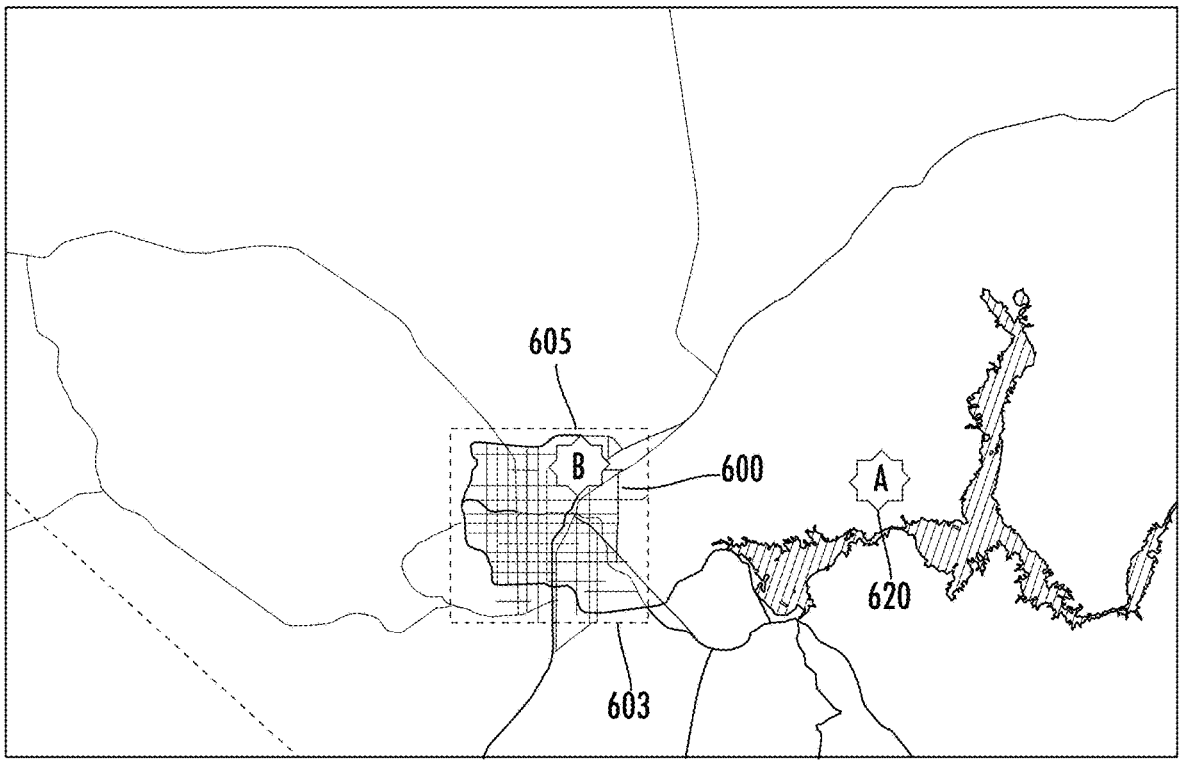
(PRIOR ART) FIG. 3
FIG. 3 is a prior art map showing a bounded geographic area in which event betting is allowed.

FIGS. 1-3 show the prior art of event betting. Sports betting or event betting is usually only allowed in certain jurisdictions 600. The jurisdiction 600 has a defined boundary 603. A gambler at a location 605, B, within the boundary 603 of the jurisdiction 600 is allowed to place a sports bet 1. A gambler at a location 620, A, outside of the boundary 603 of the jurisdiction 600 would not be allowed to place a sports bet 1. A gambler 10 uses money 11 to place a bet 1 on a present or future event 400, such as a football game, using an electronic device 200.

The electronic device 200 would be comprised of a global positioning system ("GPS") chipset 202, graphics driver 203, memory 201, communications chip 204, and screen 205. The GPS chipset or similar location-based means would be used to determine if the location of the gambler 10 was within the boundary 603 of a jurisdiction 600 that allows sports betting 1. The electronic device 200 sends a wager communication 399, 397 over a communication network 301, 302 to a server 303, requesting to make a bet on a sporting event 400. The server 303 first sends a location query 398, 396 to determine the location of the electronic device 200, using the location of the electronic device 200, as provided by the GPS chipset 202, as a proxy for the location of the gambler 10. Once the location has been determined, and the gambler 10 is allowed to place a sports bet 1, the server 303 checks 304 an historical database 310 in order to determine the appropriate odds. The odds are communicated 397, 399 back to the gambler's 10 electronic device 200 over the communications network 301, 302. The gambler 10 uses the electronic device 200 to place a bet 1. The gambler 10 then watches 401 the sporting event 400. At the conclusion of the sporting event 400, the event is graded 402. If the gambler's 10 preferred team prevailed, the server 303 issues payment.

Figure 4A:
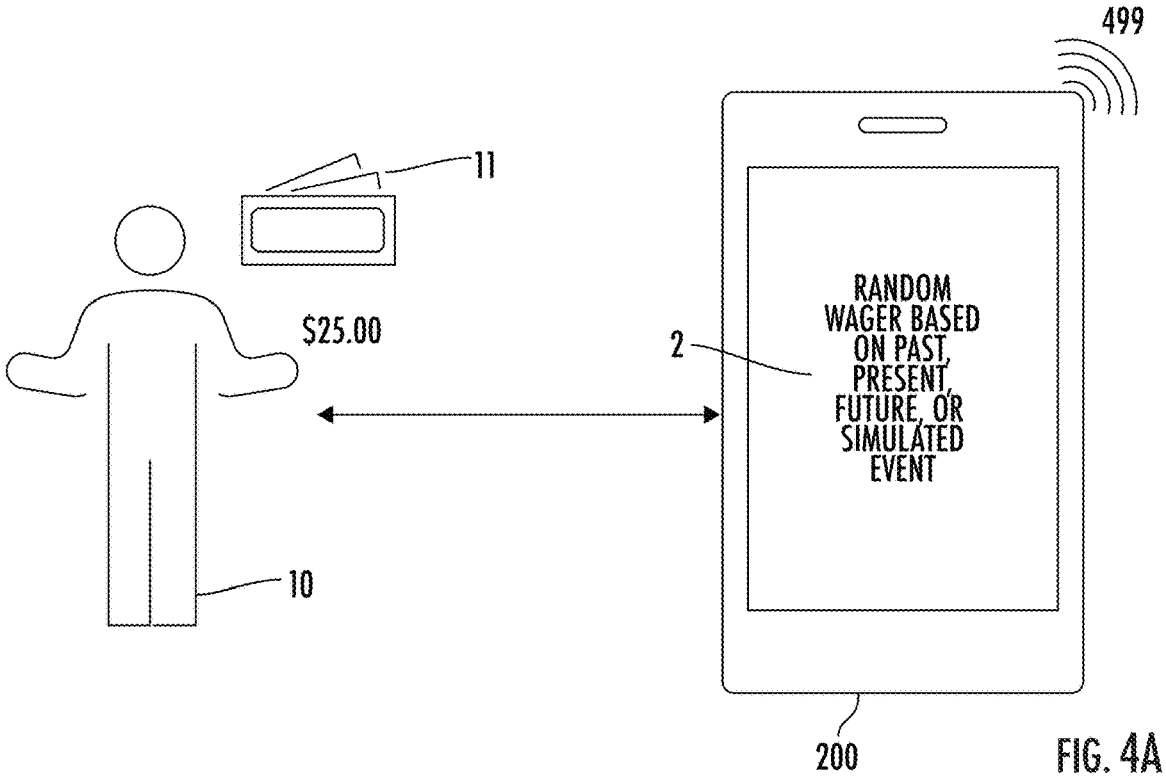
FIG. 4A is an illustration showing a gambler placing a random wager on a past, present, future, electronic, or simulated event through an electronic device.
Figure 4B:
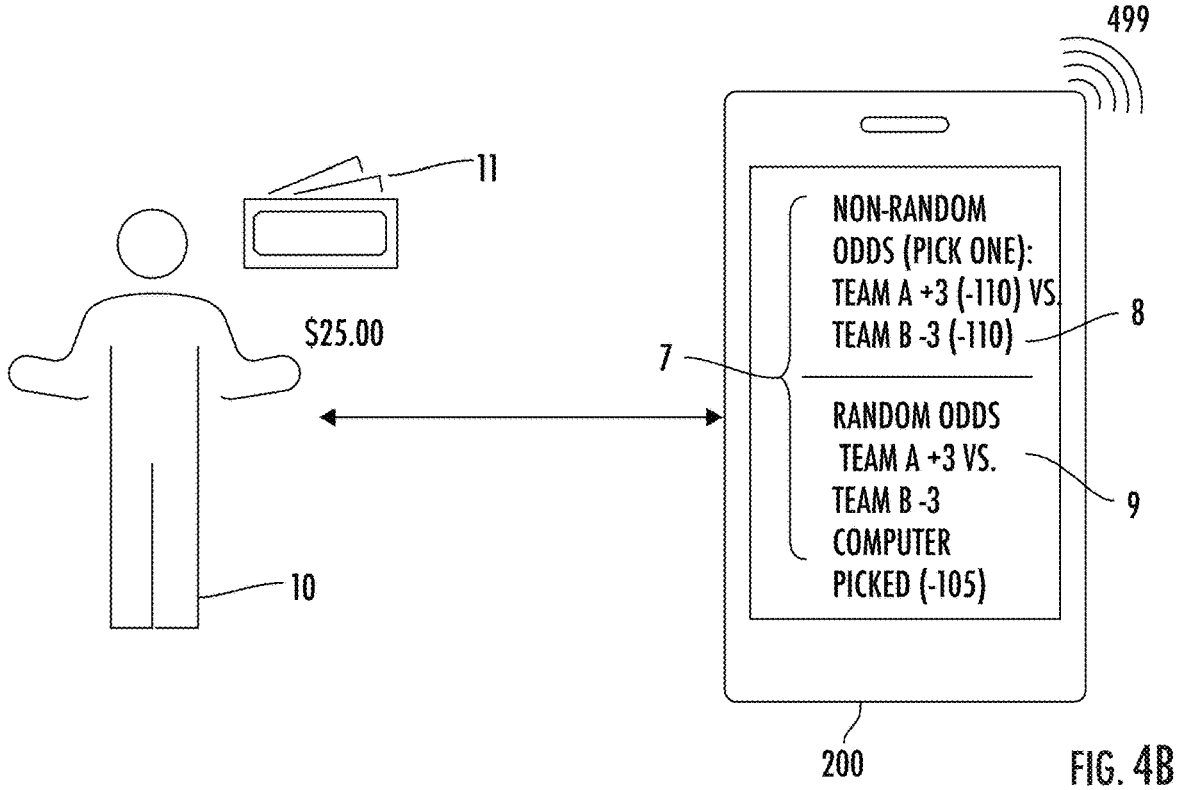
FIG. 4B is an illustration showing a gambler placing a random wager on a present or future event, using a split display.
Figure 5:
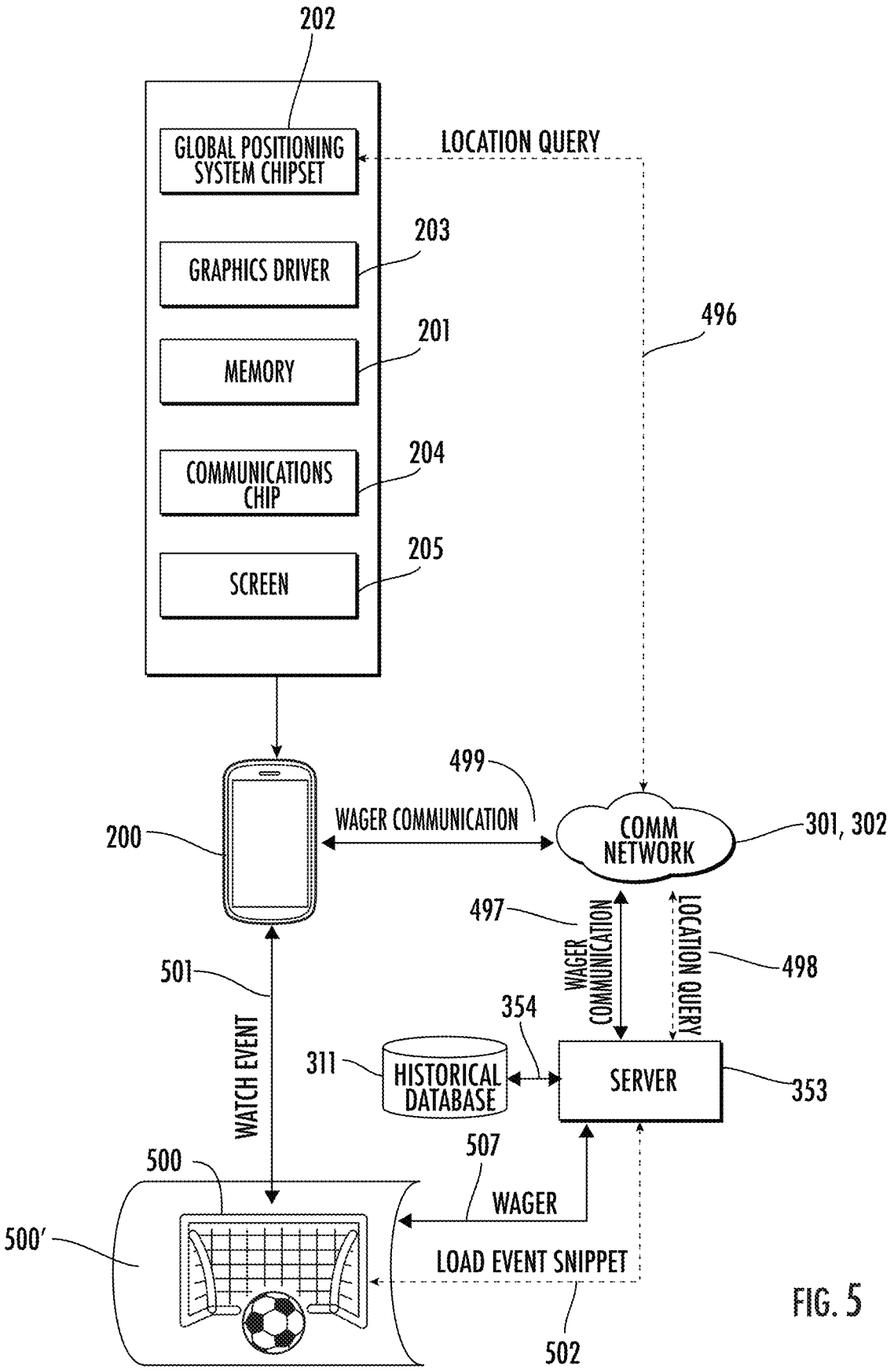
FIG. 5 is a flow chart showing the present invention's event betting from a systems level.
Figure 6:
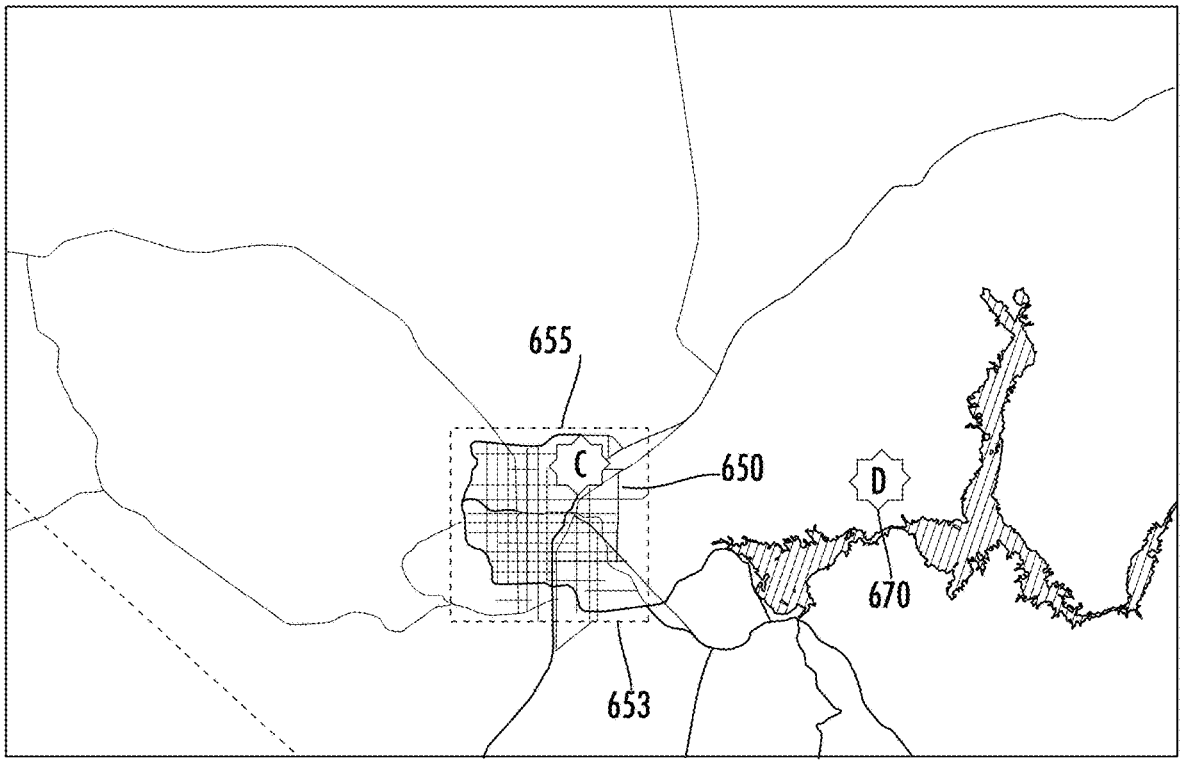
FIG. 6 is a map showing a bounded geographic area in which event betting is allowed.
Figure 7:
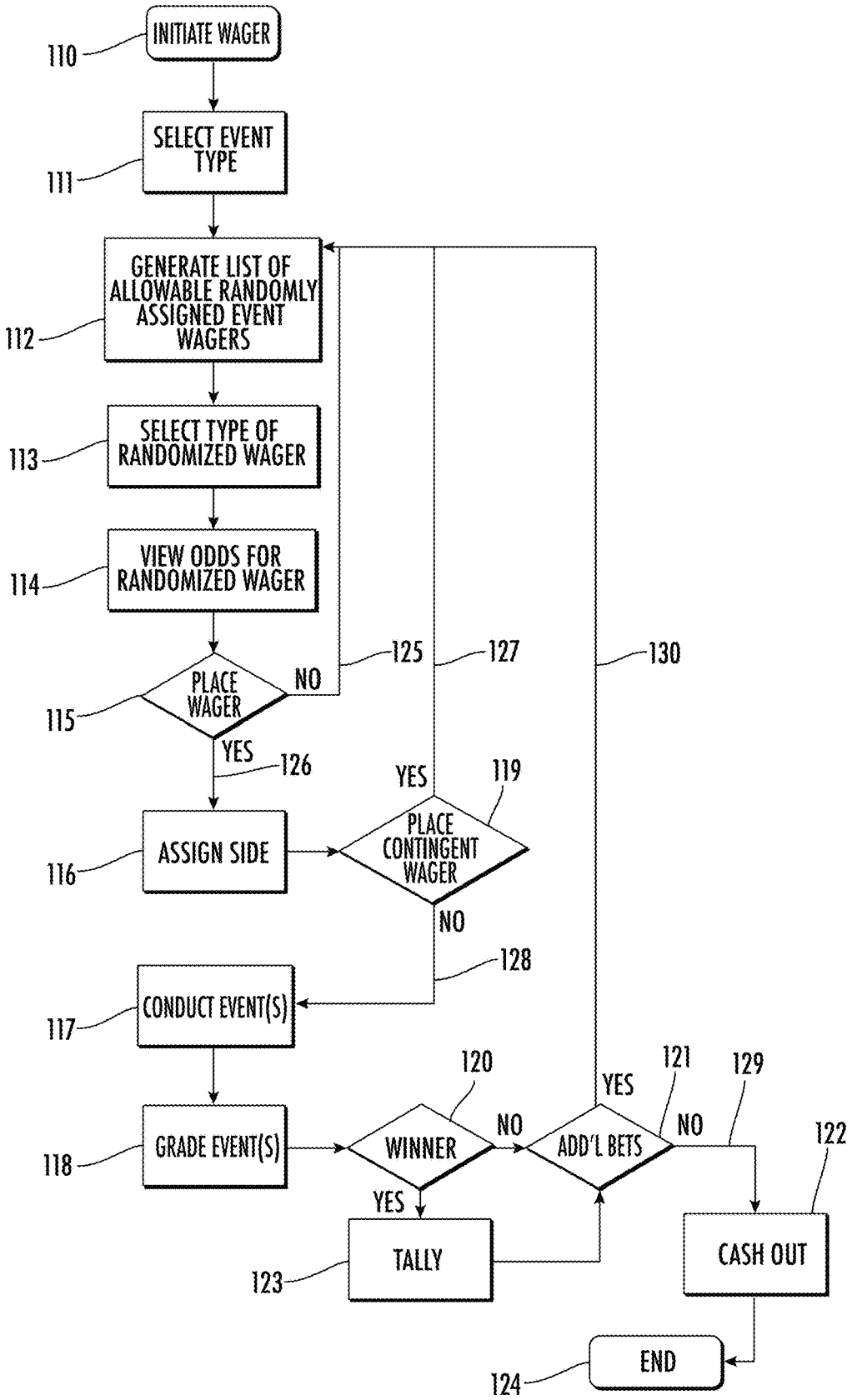
FIG. 7 is a logic flow chart of the present invention.
Figure 8:
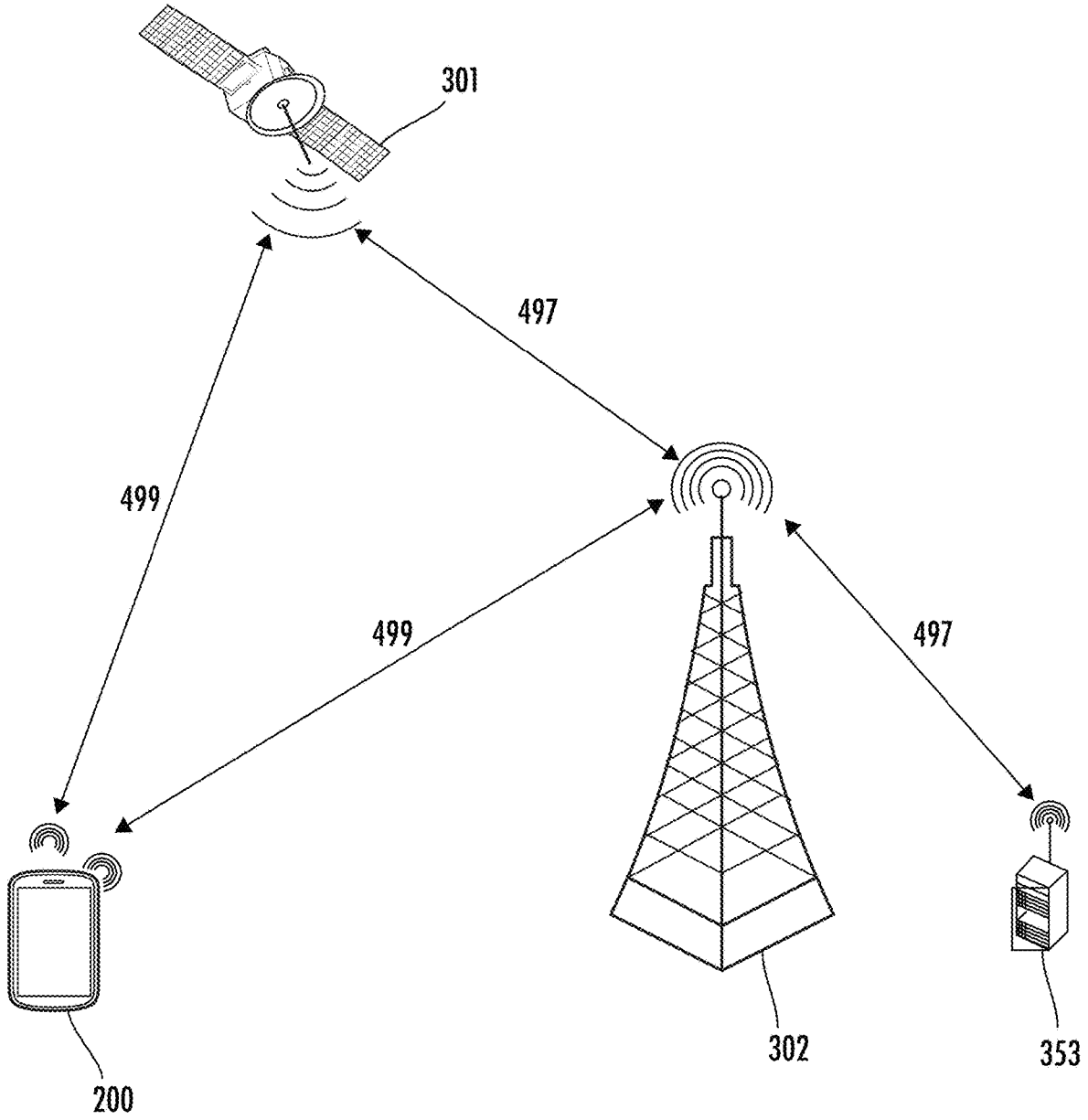
FIG. 8 is a communications diagram of the present invention.

Much of the prior art architecture is incorporated in the present invention, as shown in FIGS. 4-8. Referring now to FIGS. 6 and 8, betting on events in a manner that makes them a game of chance is usually only allowed in certain jurisdictions 650. It must be noted that in the present invention, the jurisdiction 650 must allow games of chance. The jurisdiction 650 has a defined boundary 653. A gambler at a location 655, C, within the boundary 653 of the jurisdiction 650 is allowed to place a game-of-chance bet related to a sporting event. A gambler at a location 670, D, outside of the boundary 653 of the jurisdiction 650 would not be allowed to place such a bet.

FIG. 8 shows the system communicate diagram from a high level. The gambler 10 would interact with a wagering server 353 by using an electronic device 200 to communicate 499 with a satellite 301 or cell system 302. A near-field communication protocol such as wi-fi could be used if the gambler 10 was in proximity to the wagering server 353. The satellite 301 may, itself, communicate 497 with the cell system 302. Ultimately, the cell system 497 communicates wirelessly, itself, or through the internet, or an intermediating near-field wireless communications protocol, such as wi-fi, in order to reach the wagering server 353.

Referring now, also, to FIG. 4A, a gambler 10 uses money 11 to place a bet 2 on a past, present, future, electronic, or simulated event, such as a football game, using an electronic device 200. The electronic device 200 communicates 499 information to an appropriate server 353 (See FIG. 5). However, rather than picking a side in the bet 2, the gambler 10 is pseudorandomly assigned a betting proposition by the wagering server 353. FIG. 4B shows a variation with a split screen 7 wager presentation, that is only available for present or future events. A gambler 10 uses money 11 to place a bet 7 on a present or future event, such as a football game, using an electronic device 200. The electronic device 200 provides a split or differentiated screen 7 showing the gambler 10 the odds for both a normal bet 8 in which the gambler 10 would pick the team; and a random bet 9 in which the gambler 10 would be pseudorandomly assigned a side by the wagering server 353. The electronic device 200 communicates 499 information to an appropriate server 353 (See FIG. 5). In this embodiment, the gambler 10 is presented with a choice of picking a side 8 or having a side pseudorandomly assigned 9.

Referring now also to FIG. 5, much like the prior art, the electronic device 200 would be comprised of a GPS chipset 202, graphics driver 203, memory 201, communications chip 204, and screen 205. The GPS chipset or similar location-based means would be used to determine if the location of the gambler 10 was within the boundary 653 of a jurisdiction 650 that allows betting as a game of chance. In this case, the game of chance would be the pseudorandom assignment of a bet 2, 9 on an event, such as a sporting event 500, 500'. In one embodiment, the betting 2 would be allowed on any event 500, whether past, present, future, electronic, or simulated. In another embodiment, the betting 8, 9 would only be allowed on an event 500' that was present or future in nature. The electronic device 200 sends a wager communication 499, 497 over a communication network 301, 302 to a server 303, requesting to make a bet 2, 8, 9 on a sporting event 500, 500'.

The wagering server 353 would be comprised of a processor; a non-transitory, computer-readable memory element; an instruction set stored on the non-transitory, computer-readable memory element; an historical database 311, and a connection 354 between the wagering server 353 and the historical database 311. Using a wagering server 353 to calculate odds using an historical database 311 starts with a sports book selecting past comparable events and then making a simple calculation of the ratio of the number of similar past events that produce an outcome to the number that did not produce the outcome. A sports book will then usually adjust the odds based on the popularity of the teams involved as shown by the frequency of bets on each team in the historical database. For example, in football, the Dallas Cowboys are a widely popular team, leading to many people betting for them. As a result, a sports book may adjust the odds on games involving the Dallas Cowboys in order to balance their bets. The particular method of calculating odds is beyond the scope of this application. It is sufficient to know that methods for calculating the odds from an historical database 311 exist.

In the prior art bet 1, the wager communication 399, 397 required the gambler 10 to pick a side for a bet, based on the odds for the event. The present invention allows for pseudorandomized assignment of an event-based bet 2, 9. If the gambler 10 wishes to have a randomized assignment 2, 9 the gambler 10 merely needs to pick the event. The wager communication 499, 497 communicates the gambler's 10 intent to place a randomized bet 2, 9. The server 303 then pseudorandomly assigns a bet 2, 9 to the gambler.

For example, imagine Team A and Team B playing a football game. In the prior art bet 1, the gambler 10 would communicate 399, 397 with the betting server 303 in order to view the odds. The betting server 303 would base the odds on the results from an historical database 310. For the sake of this example, let the odds be Team A −3 (−110) and Team B +3 (−110). This nomenclature means that the gambler 10 would have to place a bet of $110 dollars in order to win $100. The gambler 10 can choose Team A, giving three points (meaning that Team A needs to win by more than 3 points in order for the gambler 10 to win). Alternatively, the gambler 10 can choose Team B, getting three points (meaning that Team B needs to win or lose by 3 points or fewer in order for the gambler 10 to win the bet 1). In order to place the bet 1, the gambler 10 would pick either Team A or Team B based off of the odds given by the server 303, and would communicate 399, 397 the bet 1 to the server 303. For this example, the gambler 10 selects Team A giving 3 points and places a $110 bet. If Team A wins by more than 3 points, the gambler 10 receives $100 plus their original bet 1 of $110.

For the first embodiment of the present invention bet 2, shown in FIG. 4A, the gambler 10 would communicate 499, 497 with the betting server 353. For the sake of this example, the betting server 353 would communicate 499, 497 the pseudorandomized odds Team A −3 (−105) and Team B +3 (−105). The event 500 can be past, present, future, electronic, or simulated for such a bet 2. For example, the event 500 can be an upcoming football game. The event 500 can also be a past football game. The event 500 can even be a simulated football game. The gambler 10 could not select a team; rather, the wagering server 353 would pseudorandomly assign the gambler 10 either Team A or Team B after the gambler 10 communicated 499, 497 the intention to bet. For this example, the gambler 10 decides to place a $105 bet 2, and the wagering server 353 assigns the gambler 10 Team A. If Team A wins by more than 3 points, the gambler 10 receives $100 plus their original bet 2 of $105.

For the second embodiment of the present invention bet 8, 9, as shown in FIG. 4B, the gambler 10 would communicate 499, 497 with the betting server 353. This embodiment uses a split screen 7 in order to present the gambler 10 with both the normal odds 8 and the randomized odds 9. The split screen 7 is available only for present or future events 500'. For the sake of this example, the betting server 353 would communicate 499, 497 the normal odds 8 (Team A −3 (−110) and Team B +3 (−110)) and the randomized odds 9 (Team A −3 (−105) and Team B +3 (−105)) for a present or future event 500' such as an upcoming football game. The gambler 10 could select a team and place a bet 8 of $110 in order to get a return of $100; or the gambler could select a random bet 9 allowing the wagering server 353 to pseudorandomly assign the gambler 10 either Team A or Team B after the gambler 10 communicated 499, 497 the intention to place a random bet 9. For this example, the gambler 10 decides to place a $105 random bet 9, and the wagering server 353 pseudorandomly assigns the gambler 10 Team A. If Team A wins by more than 3 points, the gambler 10 receives $100 plus their original bet 9 of $105.

When placing a random bet 2, 9, the server 353 first sends a location query 498, 496 to determine the location of the electronic device 200, using the location of the electronic device 200, as provided by its GPS chipset 202, as a proxy for the location of the gambler 10. Once the location has been determined, and the gambler 10 is allowed to place a random bet 2, 9, the server 353 checks 354 an historical database 311 in order to determine the appropriate odds. The odds are communicated 497, 499 back to the gambler's 10 electronic device 200 over the communications network 301, 302.

If the gambler 10 is wagering 11 on a present or future event 500', the gambler 10 is presented with a split screen 7 presenting odds 8 in the event that the gambler 10 chooses a side, and the odds 9 in the event that the gambler 10 chooses a randomized bet. The gambler 10 places a wager 8 or 9. The gambler 10 then watches 501 the sporting event 500'. At the conclusion of the sporting event 500', the event is graded 507. If the gambler's 10 team prevailed, the server 353 issues payment.

The gambler 10 is pseudorandomly assigned a side in the present invention. In some events 500, 500', such as soccer or hockey, there is a significant chance of a tie. The present invention can use the possibility of a draw as an outcome to make a three outcome event. Likewise, the present invention could merely ignore the possibility of a draw, creating a push situation if a draw occurs. A push is when the bets are refunded because neither side wins or loses.

In one embodiment, the gambler 10 can wager on past, present, future, electronic, or simulated events 500. The gambler 10 can only place a wager 11 with a pseudorandom side assignment 2. If the event is a past or simulated event 500, the betting server 353 can play snippets 502 of the event on the gambler's 10 electronic device 200. For past events 500, the snippets 502 would be stored on the historical database 311. For example, the event 500 can be a football game from 1972. The gambler 10 accepts a random side assignment. The wagering server 353 pseudorandomly assigns a side from a football game from 1972. Once the bet 2 is placed, the gambler 10 can be presented with the snippet 502 of the past event 500, a football game from 1972. In another example, a group of friends can play an electronic football game 500, for example Madden®. The gambler 10 can be pseudorandomly assigned one of the two teams. The gambler 10 can then watch 501 the electronic event 500. If the gambler's 10 team prevails, the wager is paid 507, just like it would be for a real event.

There are three compelling reasons for a gambler 10 to want a randomized bet. First, a sports book always has an advantage over the betting public 10. A typical sports book requires a bet of $110 on a supposedly neutral proposition in order for the gambler 10 to make $100. The difference between the $110 bet and the $100 return is called many things such as juice, tax, or vigorish. The juice is charged in order to protect the sports book from a loss. In a purely random betting situation, a sports book would take a smaller tax, because there is no chance of the public having an advantage betting on an event when the bets are pseudorandomly assigned.

Second, the gambler 10 may not have any strong feeling about who will win or lose a present or future event 500. For example, if a group of friends watches a football game at a sports book in Las Vegas, one member of the group may not care who wins. The person has no strong feelings or beliefs about whether Team A or Team B is going to win. This person could take a randomized bet 9 instead of picking a team 8, and they would be rewarded for the pseudorandom assignment with less "juice." In fact, pseudorandomized betting assignment would make flat fee betting possible. For example, a gambler 10 could wager 11 up to $1000 on a bet in which the side is assigned by a pseudorandom process for a flat service fee of $5.

Third, many gamblers 10 like the activity of sports betting, but there is not always an acceptable present or future event 400, 500. In this case, the gambler 10 can bet on a past event and watch 501 snippets 502 of the past event 500'.

FIG. 7 shows the primary method and logic flow for the present invention. A gambler 10 would initiate a wager 110 using their electronic device 200. They would communicate 497, 499 with a wagering server 353 in order to select the type of event 120: past, present, future, electronic, or simulated.

The present invention lends itself to almost any sort of event-based betting. It can be used to place a bet for any conceivable pseudorandomly assigned propositions including, but not limited to, who wins vs. the point spread; the over/under; who scores first; who scores last; who scores first in the second half.

The present invention also lends itself multiple pseudorandom side assignments. For example, a gambler could be pseudorandomly assigned a team for every football game in a given week.

The present invention also lends itself to parlays. For example, the gambler 10 could be pseudorandomly assigned a team from two different football games: Team A −3 vs. Team B +3 and Team C −7 vs. Team D +7. The gambler 10 decides they want a parlay (+281) of a pseudorandomly assigned team from each of these two games. The present invention would assign a team to the gambler from each of the two games (e.g., Team B and Team C). The gambler 10 would bet $100. If both of the pseudorandomly assigned teams, Team B and Team C, won, the parlay would be graded 507 as a win and the gambler 10 would collect $281 plus their original bet of $100. A gambler 10 could even parlay a regular bet 1 with a pseudorandomized bet 2, 9, provided the regular bet 1 is placed first.

Randomized betting 2, 9 would also allow for batching of wagers into groups so that the groups, themselves, can be balanced. This would allow the sports book to balance its action on both sides of the line and lock in a pre-defined, risk-free profit. Batching would also allow friends to make individual bets and request that those bets be batched together.

The wagering server 353 would generate a list of allowable randomly assignable event wagers 112, and would communicate 497, 499 them back to the gambler's 10 electronic device 200. The gambler 10 would select the type of randomized wager 113, including random side assignment, proposition bets, bulk purchase of random side assignments, parlays, and batched betting. The wagering server 353 would show the gambler 10 the odds 114 for the gambler's 10 selected randomized wager 113 by communicating 497, 499 the odds to the gambler's 10 electronic device 200. After viewing the odds 114, the gambler 10 could place the wager 115 by selecting <YES> 126, or the equivalent, on the electronic device 200. If the gambler 10 decides not to bet, the gambler selects <NO> 125, or the equivalent.

If the gambler 10 decides to place 126 the bet, the wagering server 353 pseudorandomly assigns a side 116 for each proposition in the selected type of randomized wager 113. After receiving a pseudorandom side assignment 116, the gambler 10 can be presented with the choice of additional contingent bets 119, or parlays 119. If the gambler 10 selects <YES> 127, the wagering server 353 would generate an additional list of allowable random event wagers 112 that can be parlayed with the gambler's 10 already selected wager 126, and would communicate 497, 499 them back to the gambler's 10 electronic device 200. The method would then iterate.

If the gambler 10 selects <NO> 128 for additional parlays, the gambler 10 could watch the event(s) 117. At the end, the wagering server 353 would grade the events 118. If the gambler 10 was a winner 120, their winnings would be added to their tally 123. Whether a winner or loser, the gambler would be presented with a choice of making additional bets 121. If the gambler 10 selects <NO> 129, they would be cashed out 122 if they had a positive tally balance 123 and the application would end 124. If the gambler 10 wishes to make additional bets 130, the wagering server 353 would once again generate a list of allowable pseudorandomly assignable event wagers 112, and would communicate 497, 499 them back to the gambler's 10 electronic device 200, and the method would iterate.

I claim:

1. A system for placing a randomized event bet comprising:

an electronic device comprised of a global positioning system ("GPS") chipset, graphics driver, memory, communications chip, and screen;

a wagering server comprised of a processor; a non-transitory, computer-readable memory element; a computer-readable instruction set stored on the non-transitory, computer-readable memory element; an historical database, and a connection between the wagering server and the historical database;

a jurisdiction with a defined geographic boundary inside of which games of chance based on events are allowed;

a communications channel connecting the electronic device to the wagering server;

wherein the computer-readable instruction set stored on the non-transitory, computer readable memory element of the wagering server contains a criteria for determining if an electronic device with a particular GPS coordinate is eligible for placing a randomized bet on an event;

wherein the electronic device is used to initiate a wager communication between the electronic device and the wagering server in order to make a randomized bet on an event;

wherein the wagering server receives the communication and responds by sending a location query back to the electronic device;

wherein the electronic device responds to the location query by providing its location based off of information from the GPS chipset;

wherein the wagering server uses the information from the GPS chipset to verify that the electronic device can place a randomized bet on an event;

wherein the electronic device communicates an intention to place a randomized wager on an event; and wherein the wagering server pseudorandomly assigns a wagering side to the electronic device.

2. The system for placing a randomized event bet of claim 1, wherein the computer-readable instruction set stored on the non-transitory, computer readable memory element of the wagering server pseudorandomly assigns a side for an event.

3. The system for placing a randomized event bet of claim 2, wherein the computer-readable instruction set stored on the non-transitory, computer readable memory element of the wagering server possesses a means for calculating the odds of a bet in which the electronic device selects a side.

4. The system for placing a randomized event bet of claim 3, wherein the computer-readable instruction set stored on the non-transitory, computer readable memory element of the wagering server possesses a means for calculating the odds of a bet in which the wagering server pseudorandomly assigned a side.

5. The system for placing a randomized event bet of claim 4, wherein the communications channel connecting the electronic device to the wagering server uses at least one of a satellite, a cellular network, the internet, and wi-fi.

6. The system for placing a randomized event bet of claim 4, wherein the event is one of a past, present, future, electronic, and simulated sporting event.

7. The system for placing a randomized event bet of claim 6, wherein wagering server can play snippets of a past, electronic, and simulated events.

8. The system for placing a pseudorandomized event bet of claim 4, wherein the event is a present or future event, and wherein the display of the electronic device provides a split screen of information showing both the odds in the event that a user selects a side and the odds in the event that the wagering server pseudorandomly selects a side.

9. A method for placing an event bet with a randomized side assignment comprising the steps of using an electronic device comprised of a GPS chipset, graphics driver, memory, communications chip, and screen;

initiating a wagering session using the electronic device;

communicating an intent to wager from the electronic device to a wager server;

sending a location query from the wager server to the electronic device;

answering the location query with a location provided by the GPS chipset;

allowing the wagering session based on the location provided by the GPS chipset;

communicating an intent to accept a random side assignment for an event from the electronic device to the wagering server;

generating a list of allowable randomly assignable event wagers using the wagering server;

communicating the list of allowable randomly assigned event wagers from the wagering server to the electronic device;

selecting a type of randomized wager from the list of allowable randomly assigned events using the electronic device;

communicating the selected type of randomized wager from the electronic device to the wagering server;

generating the odds for a pseudorandom assignment of sides for the type of randomized wager selected by the electronic device, using the wagering server;

communicating the odds from the wagering server to the electronic device;

viewing the odds with the electronic device;

presenting on the screen of the electronic device a choice of whether to bet or not bet; and selecting a choice using the electronic device.

10. The method for placing a randomized event bet of claim 9, comprising the further step of communicating from the electronic device to the wagering server that the choice is to not bet.

11. The method for placing a randomized event bet of claim 10, comprising the further step of returning the display of the electronic device to the previously generated list of allowable randomly assignable event wagers.

12. The method for placing a randomized event bet of claim 9, comprising the further steps of communicating from the electronic device to the wagering server that the choice is to bet;

using the wagering server to pseudorandomly assign a side;

communicating the pseudorandomly assigned side from the wagering server to the electronic device;

presenting the pseudorandomly assigned side on the screen of the electronic device;

presenting on the screen of the electronic device a choice of whether to place additional contingent bets or not; and selecting a choice of whether to place additional contingent bets using the electronic device.

13. The method for placing a randomized event bet of claim 12, comprising the further steps of communicating from the electronic device to the wagering server that the choice is to not place additional contingent bets;

conducting the event;

grading the event; and providing the option on the screen of the electronic device to place more wagers.

14. The method for placing a randomized event bet of claim 12, comprising the further steps of communicating from the electronic device to the wagering server that the choice is to place additional contingent bets;

generating a list of allowable randomly assignable event contingent wagers using the wagering server;

communicating the list of allowable randomly assigned event contingent wagers from the wagering server to the electronic device;

selecting a type of randomized contingent wager from the list of allowable randomly assignable event contingent wagers using the electronic device;

communicating the selected type of randomized contingent wager from the electronic device to the wagering server;

generating the odds for a pseudorandom assignment of sides for the type of randomized contingent wager selected by the electronic device, using the wagering server;

communicating the odds from the wagering server to the electronic device;

viewing the odds of the contingent wager with the electronic device;

presenting on the screen of the electronic device a choice of whether or not to place the contingent bet;

selecting a choice using the electronic device;

communicating from the electronic device to the wagering server that the choice is to place the contingent bet;

using the wagering server to pseudorandomly assign a side to the contingent bet;

communicating the pseudorandomly assigned side for the contingent bet from the wagering server to the electronic device;

presenting the pseudorandomly assigned side on the screen of the electronic device;

presenting on the screen of the electronic device a choice of whether to place additional contingent bets or not; and selecting a choice of whether to place additional contingent bets using the electronic device.

15. The method for placing a randomized event bet of claim 9, wherein the type of randomized wager is at least one of a random side assignment, a proposition bet, a bulk purchase of random side assignments, a parlays, and batched betting.

16. The method for placing a randomized event bet of claim 15, wherein the type is a proposition bet and wherein the proposition is at least one of the over/under for total points scored, who scores first, who scores last, and who scores first in the second half.

17. The method for placing a randomized event bet of claim 15, wherein the type is a random side assignment, and the random side assignment is made with a point spread.

18. The method for placing a randomized event bet of claim 15, wherein the type is a random side assignment, and the random side assignment is made without a point spread.

19. The method for placing a randomized event bet of claim 9, wherein the event is one of a past, present, future, electronic, and simulated sporting event.

20. A method for placing a batched event bet with a common randomized side assignment comprising the steps of using a plurality of electronic device, each comprised of a GPS chipset, graphics driver, memory, communications chip, and screen;

initiating a wagering session using the electronic device;

communicating an intent to wager from each of the plurality of electronic device to a wager server;

sending a location query from the wager server to each of the plurality of electronic devices;

answering the location query for each of the plurality of electronic devices by providing a location from its GPS chipset;

allowing the wagering session for each of the plurality of electronic devices based on the location provided by the GPS chipset for each electronic device;

communicating an intent to accept a random side assignment from each of the plurality of electronic devices to the wagering server;

generating a list of allowable randomly assignable event wagers using the wagering server;

communicating the list of allowable randomly assigned event wagers from the wagering server to each of the plurality of electronic devices;

selecting a batched randomized wager from the list of allowable randomly assigned events using each of the plurality of electronic device;

communicating the selection of a batched randomized wager from each of the plurality of electronic device to the wagering server;

generating the odds for pseudorandomly assigning all of the plurality of electronic devices to the same side, using the wagering server; and communicating the odds from the wagering server to each of the plurality of electronic devices.

* * * * *